US005547388A

United States Patent [19]

Hill

[11] Patent Number: 5,547,388

[45] Date of Patent: Aug. 20, 1996

[54] CONNECTOR COVER HAVING A SQUEEZE RELEASE

[75] Inventor: Mark G. Hill, Novi, Mich.

[73] Assignee: Yazaki Corporation, Tokyo, Japan

[21] Appl. No.: 305,268

[22] Filed: Sep. 13, 1994

[51] Int. Cl.[6] ..... H01R 13/44; H01R 13/627

[52] U.S. Cl. ..... 439/135; 439/139; 439/471; 439/464; 439/371

[58] Field of Search ..... 439/135, 136, 439/139, 149, 901, 350, 902, 903, 904, 471, 464, 371

[56] References Cited

U.S. PATENT DOCUMENTS

| | | | |
|---|---|---|---|
| 4,034,284 | 7/1977 | Peplow et al. | 439/483 |
| 4,813,892 | 3/1989 | Strate | 439/680 |
| 5,106,326 | 4/1992 | Tsuji et al. . | |
| 5,192,225 | 3/1993 | Suzuki | 439/350 |
| 5,314,347 | 5/1994 | Colleran | 439/350 |
| 5,380,217 | 1/1995 | Yagi et al. | 439/350 |

FOREIGN PATENT DOCUMENTS 4-66782 6/1992 Japan .

OTHER PUBLICATIONS

U.S. patent application Ser. No. 981,849 Nov. 1992.

*Primary Examiner*—P. Austin Bradley
*Assistant Examiner*—T. C. Patel
*Attorney, Agent, or Firm*—Young & Basile

[57] ABSTRACT

The present invention relates to a tethered protective cover which is detachably mounted to a multi-pin electrical connector. Specifically, the cover is mounted to a diagnostic connector located under the instrument panel of an automobile. The cover includes a shroud which is mountable to the connector. The shroud includes opposite side walls and an intermediate wall extending therebetween. The shroud has a size and shape such that clearances are created between each shroud side wall and the connector. The shroud is formed using a resilient material such that when the opposite side walls are squeezed inwardly, the clearances are reduced, causing the intermediate wall to gap outwardly from the connector. A latch button on the intermediate shroud wall interacts with a projection on the connector to secure the shroud to the connector.

18 Claims, 2 Drawing Sheets

CONNECTOR COVER HAVING A SQUEEZE RELEASE

FIELD OF THE INVENTION

The present invention is a tethered protective cover for an electrical connector in an automobile; more particularly a diagnostic plug connector located under the instrument panel.

BACKGROUND OF THE INVENTION

Vehicles today have a variety of different electrical devices and safety features which are monitored and activated by electronic components. The electrical devices in a vehicle are interconnected using wiring harnesses and connectors. To assist a service technician when analyzing or trouble-shooting a vehicle, one or more diagnostic connectors may be connected to the wiring harnesses. The diagnostic connectors provide an access location for service technicians to attach diagnostic testing equipment. These diagnostic connectors are generally used only by the service technicians and the electrical contacts are preferably covered during normal vehicle operation.

Existing connector covers include a lock mechanism which secures the cover to the connector. However, the lock mechanism requires the user to lift a locking tab with one hand while pulling on the cover with the other hand. If the diagnostic connector is located in a confined area such as under the instrument panel, it may be difficult to reach the connector cover with both hands simultaneously. Furthermore, if the diagnostic connector is blocked from view, it will be difficult to locate and release the locking tab by feel alone.

SUMMARY OF THE INVENTION

The present invention provides a connector cover which is secure but which can be removed using one hand and without the use of any tools. The connector cover has a low attachment force and may be attached to and removed from the connector using one hand, even when the cover is hidden from view.

In general, this is accomplished through the provision of a shroud-like connector cover made of resilient plastic and of a configuration which generally, but not specifically, conforms to the outer shape of the connector. The shroud shape is such as to create clearances at opposite sides such that when said opposite sides are squeezed inwardly to reduce the clearance, the shroud gaps or separates away from a longitudinal surface of the connector. A snap-type lock is provided on the longitudinal surface and is, therefore, released by the oppositely inward deflection of the opposite side surface between which it lies. Preferably, the shroud is releasably tethered to the connector to ensure that it does not get lost.

In the preferred form, the shroud contains a pair of stepped projections on the opposite surfaces which function as finger grips for the user. The shroud further includes a latch button on the inner surface of the upper longitudinal wall which interacts with a lock projection on the connector to secure the shroud to the connector. A pair of rails extend inwardly from the inner surface of the shroud. The rails ensure that the shroud can only be attached to the connector in one orientation. Proper shroud orientation is important to ensure that the lock mechanism which secures the shroud to the connector is properly engaged.

The connector is attached to a wiring harness and contains a pair of mounting tabs for securing the connector to a panel or component of the vehicle. A locking projection extends outwardly from a longitudinal surface of the connector and interacts with the latch button on the shroud to secure the shroud to the connector. The plug end of the connector has a trapezoidal shape such that one longitudinal surface is narrower than the opposite longitudinal surface. The rails on the shroud are positioned such that the shroud may only be attached when the rails align with the narrower longitudinal surface.

In operation, the retaining clip is secured to the wiring harness by engaging the lock mechanism. Once the retaining clip is secured, the shroud will not be lost during shipping or further assembly procedures. To attach the shroud to the connector, the shroud must be positioned such that the rails align with the narrow longitudinal surface of the connector. As the shroud is urged onto the connector, the latch button on the shroud slides over the lock projection on the connector. As the latch button slides over the lock projection, the shroud wall is deflected. When the latch button passes the lock projection, the shroud wall returns to its original shape, securing the shroud to the connector.

To remove the shroud, the user grasps the shroud at opposite ends, using the stepped projections to obtain a firm grip. The user then squeezes the shroud which automatically causes the shroud wall to deflect away from a longitudinal surface of the connector. As the shroud wall deflects, the latch button is moved away from the locking projection on the connector. When the latch button has moved past the locking tab, the shroud may be removed by pulling it away from the connector. Since the shroud wall automatically deflects, thereby releasing the latch button, only one hand is required to remove the cover. Since there is no locking tab for the user to locate and release, the cover may be removed even when hidden from view, i.e., by feel alone. After removal, the shroud remains attached to the wiring harness with the tether and retaining clip.

The shroud may be attached and removed repeatedly without damaging the shroud or the locking mechanism.

DETAILED DESCRIPTION OF THE PREFERRED EMBODIMENT

Figure 1:
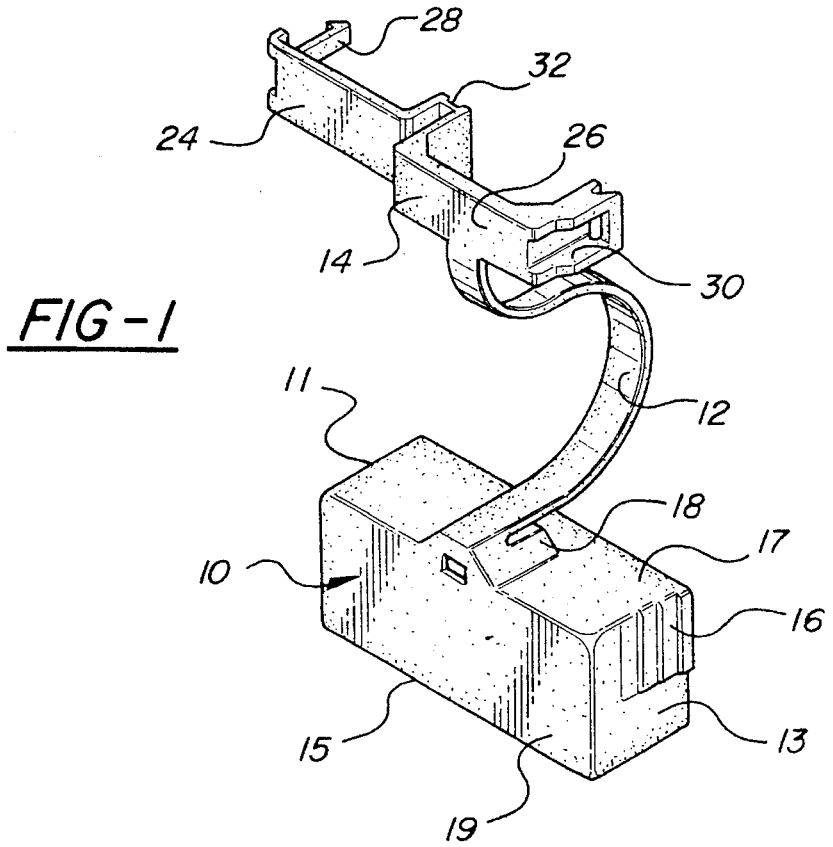
FIG. 1 is a perspective view of the inventive connector cover.

FIG. 1 illustrates a connector cover having a generally rectangular shroud 10, an integral tether 12, and a retaining clip 14. Shroud 10 and tether 12 are preferably integrally molded from a resilient plastic material such as polypropylene. The shroud exhibits two parallel side walls 11 and 13, two parallel longitudinal walls 15 and 17 and a back wall 19.

Stepped projections 16 are formed on the outer surface of each side wall 11 and 13 to provide finger grips for the user during installation or removal of the connector cover.

Figure 2:
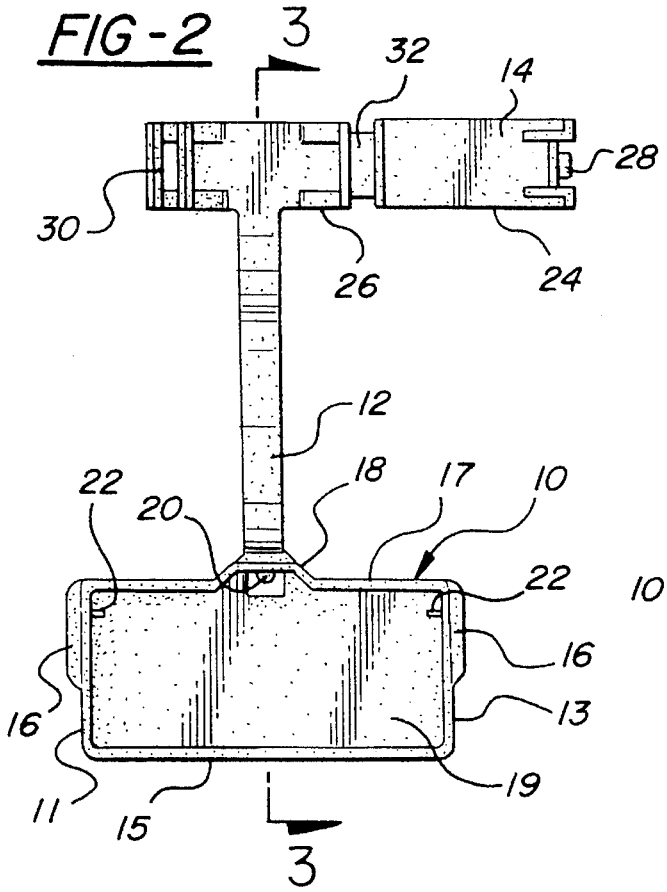
FIG. 2 is an elevational view of the connector cover, looking into the shroud cavity.
Figure 3:
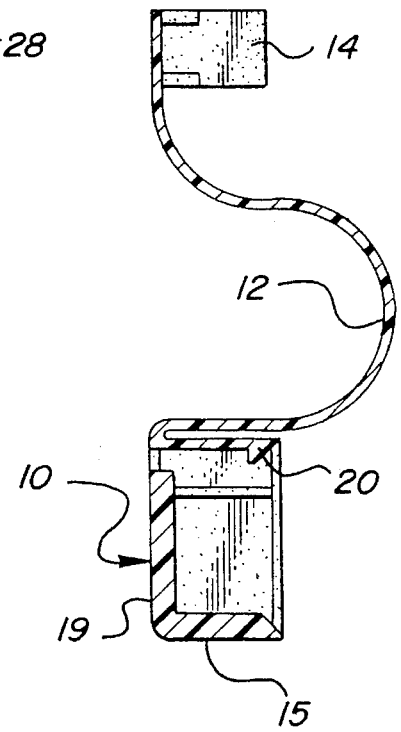
FIG. 3 is a side cross-sectional view of the connector cover.

Referring to FIG. 2, shroud 10 is open on one side, forming a rectangular cavity. As oriented in FIG. 2, the top side 17 of shroud 10 has a raised portion 18 located midway between the side walls 11 and 13. A latch button 20 extends inwardly from raised portion 18, into the rectangular cavity.

A pair of rails 22 extend inwardly from the inner surface of each side wall 11, 13. A rail 22 is formed on shroud 10 opposite each stepped projection 16.

Retaining clip 14 has a first clip portion 24 and a second clip portion 26 which are connected with an integral hinge 32. Tether 12 is integrally molded to second clip portion 26. Clip portions 24, 26 may be pivoted between an open position and a closed position. First clip portion 24 includes a locking tab 28 located opposite hinge 32. Second clip portion 26 has a locking slot 30 located opposite hinge 32. Locking tab 28 engages locking slot 30 to secure clip portions 24, 26 in the closed position.

Although a particular bayonet-type locking mechanism has been described, it will be understood that other locking mechanisms may be used to secure retaining clip 14 in the closed position.

Figure 4:
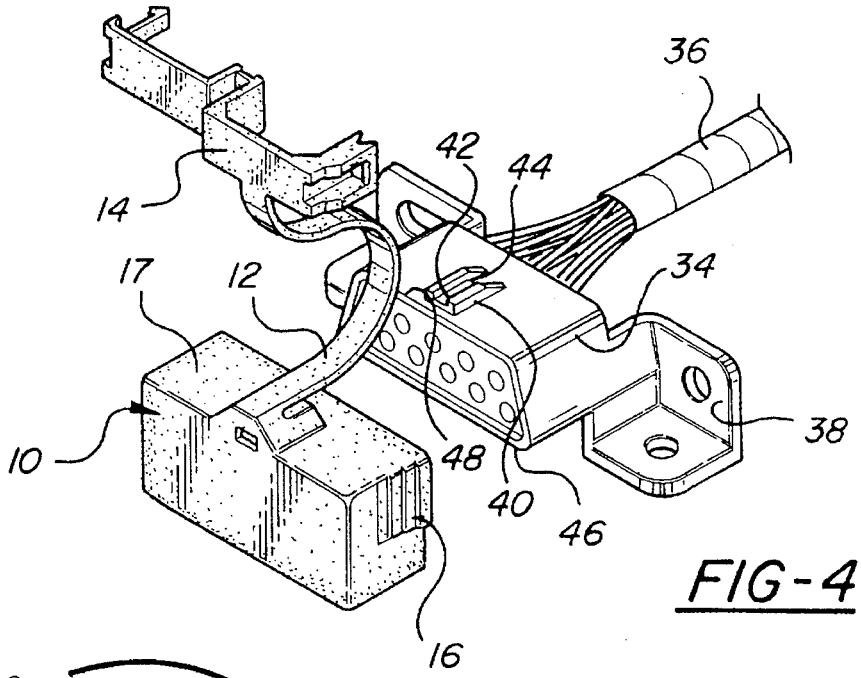
FIG. 4 is a perspective view of the connector with the shroud removed and the retaining clip detached.

Referring to FIG. 4, the connector cover mounts to a connector 34 which is attached to one end of a wiring harness 36. Integral mounting tabs 38 on connector 34 are used to secure the connector to a vehicle panel (not shown). Alternatively, connector 34 may be secured to a vehicle component or other mounting surface. Connector 34 has a trapezoidal shape such that, as viewed in FIG. 4, the sides taper inwardly creating opposite clearances between the connector sides and the shroud side walls 11 and 13. Rails 22 only permit shroud 10 to be attached to connector 34 in one orientation. Rails 22 must be positioned near top surface 48 which is narrower and provides an open space for the rails to slide along the outer surface of connector 34. If one attempts to install the shroud upside down, the rails will block the cavity and prevent shroud 10 from being attached to connector 34.

A lock projection 40 is formed on top surface 48 of connector 34. Lock projection 40 has a raised portion 42 and an edge 44. Raised portion 42 aligns with latch button 20 when shroud 10 is properly aligned with connector 34.

Figure 5:
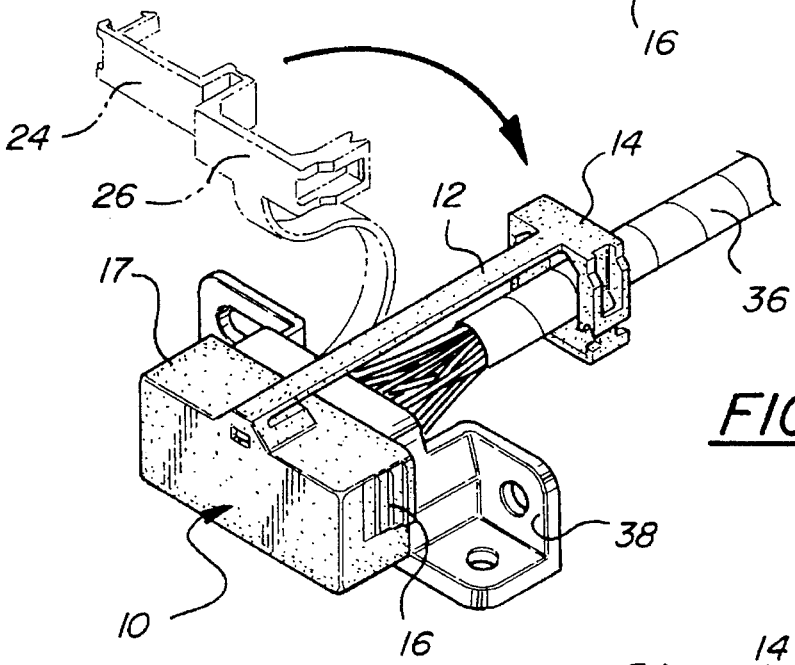
FIG. 5 is a perspective view of the connector with the shroud attached, showing attachment of the retaining clip.
Figure 6:
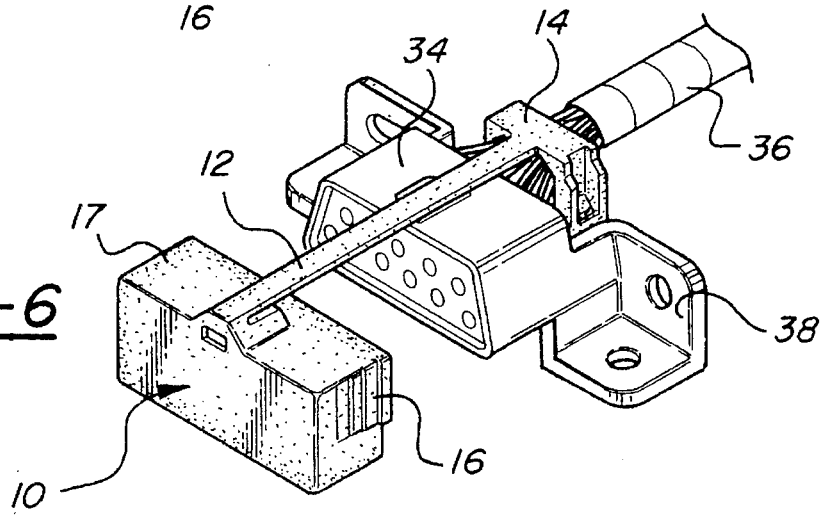
FIG. 6 is a perspective view of the connector with the retaining clip attached and the shroud removed.

In operation, the connector cover is first secured to wiring harness 36 using retaining clip 14. As shown in FIG. 5, clip 14 is secured to wiring harness 36 by pivoting the two clip portions 24, 26 to the closed position such that they surround the wiring harness. Clip portions 24, 26 are urged together causing locking tab 28 to slide into locking slot 30, thereby locking clip 14 in the closed position. Once secured, clip 14 in combination with tether 12 prevent shroud 10 from being lost during subsequent shipping or assembly procedures. Also, clip 14 prevents loss of shroud 10 when connector 34 is accessed by a service technician.

To attach shroud 10 to connector 34, the user first grasps the shroud using stepped projections 16. Shroud 10 is then aligned with connector 34 such that rails 22 align with the narrow top surface 48. Shroud 10 cannot be attached to connector 34 if the shroud is not oriented properly, thus preventing inverted installation of the shroud which would not create the necessary interaction between latch button 20 and lock projection 40.

After proper alignment, shroud 10 is urged onto connector 34, causing latch button 20 to contact lock projection 40. As additional force is applied to shroud 10, latch button 20 slides over raised portion 42 of lock projection 40, causing the wall of shroud 10 to deflect away from connector 34. With continued force, latch button 20 slides along raised portion 42 and eventually slides past projection edge 44. As latch button 20 passes edge 44, the shroud wall returns to its original shape and secures shroud 10 to connector 34. The interaction between latch button 20 and edge 44 prevents shroud 10 from accidentally sliding off from connector 34.

To remove the connector cover, a user first grasps shroud 10 at opposite sides 11 and 13 using stepped projections 16. As the user squeezes shroud 10, the side clearances close and upper shroud wall 17 deflects outwardly. As shroud wall 17 deflects, latch button 20 is deflected away from connector 34. As the shroud wall 17 continues to deflect, latch button 20 moves past edge 44 of lock projection 40. At this point, shroud 10 is no longer secured to connector 34, and the shroud may be removed by pulling the shroud away from the connector. Retaining clip 14 remains attached to wiring harness 36 and, by way of tether 12, prevents loss of shroud 10.

Shroud 10 may be repeatedly attached and removed from connector 34 without damaging the cover or reducing its ability to be secured to the connector.

Although a particular embodiment of the present invention has been described as used on a diagnostic connector for a vehicle, the cover can be used with any terminal, plug, connector, or other device which requires a releasable cover. Different shapes of shrouds and connectors can provide the squeeze-to-release function. For example, the sides of the connector may be made concave while the connector is square or rectangular. Conversely, the connector may be rectangular while the shroud is convex at the sides. Further, the connector may be rectangular or square while the cover has a trapezoidal shape. Shroud walls which are not intended to deflect can be made rigid by using reinforcing ribs or otherwise making the non-deflecting wall less resilient. The important function is provided by opposite clearances and an intermediate wall which deflects when the clearances are squeezed closed.

I claim:

1. A cover securable to a connector, said cover comprising:

a shroud having opposite side walls and an intermediate wall extending therebetween, said shroud being of such size and shape as to cover and generally conform to the outer shape of the connector, but providing opposite clearances between the side walls and the connector, the shroud being formed of a resilient material such that squeezing the side walls closes said clearances and causes the intermediate wall to gap outwardly from the connector;

a latch extending inwardly from the inner surface of the intermediate wall;

means for limiting attachment of the shroud to the connector to one predetermined spatial relationship therebetween;

retaining means securable to a wiring harness; and a tether connected between the shroud and the retaining means.

2. The apparatus of claim 1 further including stepped projections located on the outer surface of each of said side walls.

3. The apparatus of claim 1 wherein said means for limiting the attachment of the shroud to the connector comprises a pair of rails extending inwardly from the inner surface of each of said side walls.

4. The apparatus of claim 1 wherein said tether is of sufficient length to permit the cover to be removed from the connector without detaching the retaining clip from the wiring harness.

5. A cover securable to a connector, the connector being attached to a wiring harness and having a lock projection, said cover comprising:

a shroud having opposite side walls and an intermediate wall extending therebetween, said shroud being of such size and shape as to cover and generally conform to the outer shape of the connector, but providing opposite clearances between the shroud side walls and the connector, the shroud being formed of a resilient material such that squeezing the side walls closes said clearances and causes the intermediate wall to gap outwardly from the connector;

a latch extending inwardly from the inner surface of the intermediate wall;

means for limiting attachment of the shroud to the connector to one predetermined spatial relationship therebetween;

a retaining clip securable to the wiring harness; and a tether connected between the shroud and the retaining clip, said retaining clip having an open position and a closed position.

6. The apparatus of claim 5 further including stepped projections located on the outer surface of each of said side walls.

7. The apparatus of claim 5 wherein said means for limiting attachment of the shroud to the connector comprises a pair of rails extending inwardly from the inner surface of each of said shroud side walls.

8. The apparatus of claim 5 wherein said latch on the cover is adapted to engage said connector lock projection.

9. The apparatus of claim 5 wherein the retaining clip has a first clip portion, a second clip portion, and a hinge connecting said first and second clip portions.

10. The apparatus of claim 9 wherein the retaining clip further includes a locking tab on the first clip portion and a locking slot on the second clip portion, said locking tab adapted to be engaged with said locking slot to secure said retaining clip in the closed position.

11. A combination of a connector and a protective cover securable to the connector comprising:

a relatively rigid connector body having parallel top and bottom surfaces, non-parallel, inwardly tapering side surfaces, and an end surface with electrical connector means therein;

a flexible cover comprising a shroud having opposite side walls and intermediate walls extending therebetween, said side and intermediate walls forming a cavity of such size and shape as to generally conform to the outer shape of the connector and substantially enclose the connector when the shroud is disposed thereover, but providing opposite clearances between the cover side walls and the connector side surfaces such that squeezing the side walls closes said clearances and causes at least one of the intermediate walls to flex outwardly from the connector;

a latch extending inwardly from the inner surface of said at least one intermediate wall; and a lock projection disposed on the connector and engaged with said latch when the cover is unflexed.

12. The apparatus of claim 11 further including means for limiting attachment of the shroud to the connector to one predetermined spatial relationship therebetween.

13. The apparatus of claim 11 further including stepped projections located on the outer surface of each of said side walls.

14. The apparatus of claim 13 wherein said means for limiting the attachment of the shroud to the connector comprises a pair of rails extending inwardly from the inner surface of each of said side walls.

15. The apparatus of claim 11 further including a retaining means securable to a wiring harness, and a tether connected between the shroud and the retaining means.

16. The apparatus of claim 15 wherein the retaining means comprises a retaining clip having an open position and a closed position.

17. The apparatus of claim 16 wherein the retaining clip has a first clip portion, a second clip portion, and a hinge connecting said first and second clip portions.

18. The apparatus of claim 17 wherein the retaining clip further includes a locking tab on the first clip portion and a locking slot on the second clip portion, said locking tab adapted to be engaged with said locking slot to secure said retaining clip in the closed position.

* * * * *